US010278508B2

(12) United States Patent
Breibart

(10) Patent No.: US 10,278,508 B2
(45) Date of Patent: May 7, 2019

(54) SPINAL ALIGNMENT METHOD FOR SEATED POSTURE AND ASSOCIATED APPARATUS

(71) Applicant: PHYSICALMIND, INC., New York, NY (US)

(72) Inventor: Joan Breibart, New York, NY (US)

(73) Assignee: PHYSICALMIND, INC., New York, NY (US)

( * ) Notice: Subject to any disclaimer, the term of this patent is extended or adjusted under 35 U.S.C. 154(b) by 0 days.

(21) Appl. No.: 15/878,665

(22) Filed: Jan. 24, 2018

(65) Prior Publication Data

US 2018/0206646 A1 Jul. 26, 2018

Related U.S. Application Data

(60) Provisional application No. 62/449,860, filed on Jan. 24, 2017.

(51) Int. Cl.

| | |
|---|---|
| ***A47C 7/46*** | (2006.01) |
| ***A47C 7/18*** | (2006.01) |
| ***A47C 7/42*** | (2006.01) |
| *A47C 7/02* | (2006.01) |

(52) U.S. Cl.

CPC ..... *A47C 7/46* (2013.01); *A47C 7/18* (2013.01); *A47C 7/425* (2013.01); *A47C 7/021* (2013.01); *A47C 7/029* (2018.08)

(58) Field of Classification Search

CPC .. A47C 7/46; A47C 7/18; A47C 7/425; A47C 7/029; A47C 7/021; A47C 7/40; A47C 7/42; B60N 2/663

USPC ..... 297/284.4, 284.5

See application file for complete search history.

(56) References Cited

U.S. PATENT DOCUMENTS

| | | | | | |
|---|---|---|---|---|---|
| 2,081,111 | A * | 5/1937 | Manley | B60N 2/7005 | 297/284.9 |
| 2,582,115 | A * | 1/1952 | Goodeve | A47C 7/425 | 297/230.11 |
| 3,279,849 | A * | 10/1966 | Radke | A47C 7/425 | 297/284.5 |
| 3,905,058 | A * | 9/1975 | Horsfield | A47C 7/425 | 297/284.5 |
| 4,362,334 | A * | 12/1982 | Ross | A47C 7/405 | 297/230.12 |
| 4,471,993 | A * | 9/1984 | Watson | A47C 7/425 | 297/230.13 |
| 4,634,176 | A * | 1/1987 | Scott | A47C 7/425 | 297/230.13 |
| 4,796,315 | A * | 1/1989 | Crew | A61F 5/028 | 5/630 |
| 5,544,378 | A * | 8/1996 | Chow | A47C 7/383 | 297/397 |

(Continued)

*Primary Examiner* — Mark R Wendell

(74) *Attorney, Agent, or Firm* — R. Neil Sudol; Henry D. Coleman

(57) ABSTRACT

An apparatus for improving sitting posture has a pair of cushion members and a belt or strap connected to the cushion members for attaching the cushion members to a seat back at spaced locations thereon. The device is attached to a seat back so that the cushion members are positioned along or proximate respective vertical edges of the seat back, are spaced from one another and are located at substantially the same height or vertical distance from a horizontal buttocks support member attached to the seat back.

16 Claims, 7 Drawing Sheets

(56) References Cited

U.S. PATENT DOCUMENTS

| | | | | | |
|---|---|---|---|---|---|
| 5,547,251 | A * | 8/1996 | Axelson | A61G 5/10 | 297/188.04 |
| 5,572,757 | A * | 11/1996 | O'Sullivan | A47C 7/46 | 297/284.5 |
| 5,722,725 | A * | 3/1998 | McNaughton | A47C 7/425 | 297/284.3 |
| 5,868,463 | A * | 2/1999 | MacKenzie | A47C 7/021 | 297/228.12 |
| 6,299,248 | B1 * | 10/2001 | Gennaro | A47C 7/425 | 297/219.1 |
| 6,435,617 | B1 * | 8/2002 | McNair | B60N 2/882 | 297/397 |
| 6,783,175 | B1 * | 8/2004 | Henderson | A45F 4/06 | 297/219.1 |
| 7,059,678 | B1 * | 6/2006 | Taylor | A47C 7/405 | 297/284.4 |
| 2008/0023996 | A1 * | 1/2008 | Bard | A47C 7/42 | 297/284.4 |
| 2011/0031792 | A1 * | 2/2011 | Sun | A47C 7/42 | 297/284.5 |

* cited by examiner

Fig. 8
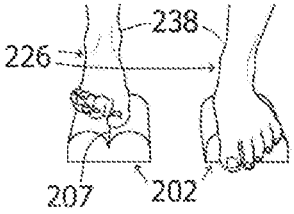
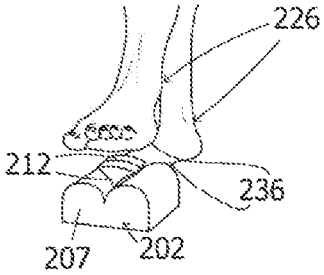
Fig. 9
Fig. 10
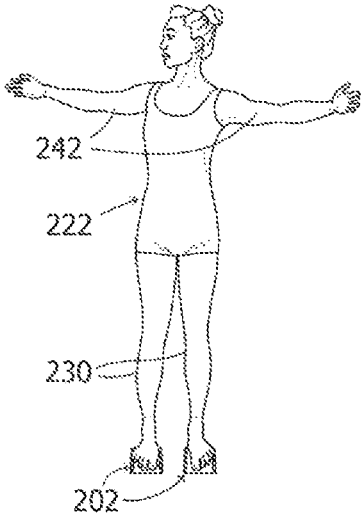

SPINAL ALIGNMENT METHOD FOR SEATED POSTURE AND ASSOCIATED APPARATUS

BACKGROUND OF THE INVENTION

This invention relates to a device or apparatus for use in maintaining postural alignment in a seated position. The device is particularly useful for those who spend the major part of the work day in a seated position at a desk. The invention also relates to a method for facilitating the maintenance of postural alignment in a seated position.

It is well known that sitting all day wreaks havoc on one's back. Those whose occupations require sitting in the same seat all day long, with hardly a break, are those especially prone to chronic back pain and spinal discomfort. Most office workers suffer from back pain occasioned by improper posture while seated in front of their computers.

OBJECTS OF THE INVENTION

It is an object of the present invention to provide a device and/or an associated method for reducing chronic back pain owing to sitting all day.

It is a more specific object of the present invention to provide such device and/or an associated method that alleviates or reduces chronic back pain by assisting the user in maintaining postural or spinal alignment in a seated position and to facilitate thoracic ribcage breathing.

Another specific object of the present invention is to provide such device and/or an associated method that alleviates or reduces chronic back pain by providing tactile feedback to the user along the user's back—particularly in the thoracic region—to facilitate and enhance postural awareness and spinal alignment in a seated position.

These and other objects of the present invention will be apparent to one skilled in the art from the drawings and descriptions herein. Although every feature of the invention is attained in at least one embodiment of the invention, there is not necessarily any one embodiment that achieves all of the objects of the invention.

SUMMARY OF THE INVENTION

An apparatus for improving sitting posture comprises, in accordance with the present invention, a pair of cushion members and at least one attachment device connected to the cushion members for attaching the cushion members to a seat back at spaced locations thereon.

The attachment device preferably comprises a belt or strap. The cushion members are spaced from one another along the belt or strap. Preferably the strap or belt is an elastic band that is stretched around the seat back. Alternatively, where the belt or strap is inelastic, it may be provided with a buckle, a pair of co-acting hook and loop members (VELCRO) or other fasteners to lock the belt or strap and concomitantly the cushion members to the seat back. The cushion members may be slid along the belt or strap before or after the attachment thereof to the seat back, to adjust the spacing of the cushion members and thus adapt the device to the user's personal requirements.

Preferably, the cushion members each include a body enveloped or held in a casing. The casing is provided with a plurality of slits, preferably exactly two, the belt or strap being inserted through and traversing the slits, thereby slidably securing the cushion members to the belt or strap.

Preferably, the body of each of cushion member is flat or planar on one major side and formed with a pair of substantially semi-cylindrical surfaces on an opposite major side, the substantially semi-cylindrical surfaces being separated from one another by an elongate groove or cleft. It is contemplated that, on attachment of the cushioning apparatus to a seat back, the cylindrical surfaces of the cushion member bodies face away from the seat back of the chair with the grooves, clefts or recesses oriented horizontally—orthogonally to the user's spinal column—and with the belt or strap passing over and lodged partially within the grooves or clefts.

A method for maintaining spinal alignment in a seated position comprises providing a pair of cushion members and attaching the cushion members to a seat back along or proximate respective vertical edges of the seat back, so that the cushion members are spaced from one another and are located at substantially the same height or vertical distance from a horizontal buttocks support member attached to the seat back. The cushion members may be placed high for engaging the thoracic portion of a user's back or lower down, for instance, in the lumbar area.

The attaching of the cushion members to the seat back preferably includes fastening a belt or strap about the seat back, the cushion members being attached to the belt or strap.

The cushion members may include respective covers or casings each provided with at least one set of mutually parallel slits, the attaching of the cushion members to the seat back includes inserting the belt or strap through the slits.

In a preferred embodiment, the covers or casing are in the form of sleeves, that is, cylindrical loops or endless belts of fabric material with openings on opposite sides through which the cushion members may be removably inserted into the covers or casings.

While the user sits on the horizontal support member and rests his or her back against the seat back and the cushion members attached thereto, the user takes slow breaths, expanding the rib cage into the cushion members, increasing awareness of the back's posture. The user becomes more cognizant of spinal alignment and back posture, and tends to sit straighter, moving the head also into a better postural position, thereby reducing the misalignment and bad posture that leads to chronic back pain.

The device and method are designed for use with an office chair or a dining room chair but can be used with any chair having a seatback which may be encircled by the belt or strap of the posture-awareness device pursuant to the invention. The cushions are supportive blocks that lift the torso and push the thoracic part of the spine forward when the cushions are disposed at the height of the thoracic spine of the user and the user leans against the cushions. Use of the present invention enables the user to sit in a bio-mechanically better position for longer periods of time. Instead of being compressed in the lumbar area, the user can feel that portion of the back being lengthened and supported. There is a feeling of more space. In addition, the cushion body members can be removed from the casings so that the user can stand on them and provide the feet with a recovery program since improper sitting can adversely affect the knees and feet as well.

BRIEF DESCRIPTION OF THE DRAWINGS

FIGS. 5-9 are respective partial perspective views showing exercises using cushion members included in the device of FIG. 4.

FIG. 10 is a perspective view of a person using, in another exercise, a cushion member included in the device or assembly of FIG. 4.

DETAILED DESCRIPTION

Figure 1:
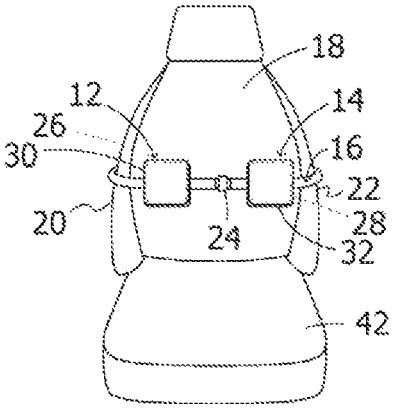
FIG. 1 is a schematic front elevational view of a front seat of a CHAIR, showing a device in accordance with the invention in position on the seat pursuant to a method in accordance with the invention.

As depicted in FIG. 1, an apparatus or device 10 for improving one's sitting posture particularly exemplarily for use by office workers and others who sit at a desk or a computer during long periods comprises a pair of cushion members 12 and 14 and at least one attachment device 16 connected to the cushion members for attaching the cushion members to a seat back 18 in spaced relationship to one another. One cushion member 12 is positioned proximate one vertical side or edge 20 of seat back 18, while the other cushion member 14 is placed near an opposite vertical side or edge 22 of the seat back. Thus cushion member 12 is much closer to side 20 than to side 22, while cushion member 14 is much closer to side 22 than to side 20.

Attachment device 16 preferably comprises a belt or strap. Cushion members 12 and 14 are spaced from one another along the belt or strap. Belt or strap 16 is typically provided with a buckle 24, or a pair of co-acting hook and loop members (VELCRO) or other fasteners to lock the belt or strap and concomitantly the cushion members 12 and 14 to the seat back 18. Cushion members 12 and 14 may be slid along belt or strap 16 before or after the attachment of the device to seat back 18, to adjust the spacing of the cushion members and thus adapt the device to the user's personal requirements. Cushion members 12 and 14 are so positioned in order to contact the user's back along the sides thereof, under the armpits.

Figure 2:
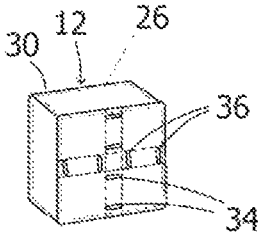
FIG. 2 is a schematic perspective view of a cushion member depicted in FIG. 1, showing a slit casing or cover in accordance with the invention.
Figure 3:
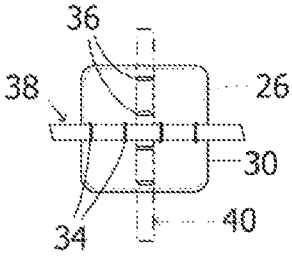
FIG. 3 is a rear elevational view of the cushion member of FIGS. 1 and 2, showing attachment of a belt or strap, which is part of the device of FIG. 1.

Preferably, cushion members 12 and 14 each include a body 26 and 28 made of resiliently compressible material such as closed cell polymeric foam and further includes a respective casing 30 and 32 which envelops and contains the cushion body 26 and 28. As depicted in FIGS. 2 and 3 each casing 30, 32 is provided on a rear major side (and optionally on the front major side as well) with a plurality of slits 34 and 36 arranged in two linear arrays, slits 34 extending perpendicularly to slits 36, the arrays defining two alternative orientations of belt or strap 16 relative to the cushion member 12 or 14. Belt or strap 16 is inserted through and traverses the slits 34 or the slits 36, thereby slidably securing the cushion members 12 and 14 to the belt or strap 16. The two groups or sets of mutually perpendicular slits 34 and 36 arranged in respective linear arrays enables the user to attach belt or strap 16 to each one of the cushion members 12 and 14 in mutually orthogonal orientations 38 and 40, as shown in FIG. 3.

Slits (not shown) may be provided in each casing 30 and 32 along the front side of the respective cushion member 12, 14. This option is advantageous where the cushion members 12 and 14 are asymmetrically formed as described hereinafter with respect to FIG. 4.

A method for maintaining spinal alignment in a seated position comprises providing cushion members 12 and 14 and attaching them to seat back 18 along or proximate respective vertical edges 20 and 22 thereof, so that the cushion members are spaced from one another and are located at substantially the same height or vertical distance from a horizontal buttocks support member 42 attached to the seat back 18. Thus the device 10 or 200, including the cushion members, is positioned in posterior lateral area or side body, exemplarily about 6 inches down from the armpits.

The attaching of the cushion members 12 and 14 to the seat back preferably includes fastening belt or strap 16 about seat back 18, the cushion members being attached to the belt or strap. Where cushion members 12 and 14 include respective covers or casings 30 and 32 each provided with at least one set of mutually parallel slits 34 or 36, the attaching of the cushion members to the seat back 18 includes inserting belt or strap 16 through the slits.

Where the covers or casings 30 and 32 are each provided with at least two sets of mutually parallel slits 34 and 36 (one set of slits is an option), the attaching of a respective one cushion member 12 or 14 to seat back 18 includes inserting belt or strap 16 through slits 34 or 36. The method may then further comprise removing or detaching belt or strap 16 from the respective cushion member 12 or 14, rotating that cushion member relative to the belt or strap, and re-inserting the belt or strap through the other set of slits 36 or 34. Thus the orientation of the cushion member relative to the user's back may be changed inasmuch as the relative orientation 38 or 40 of belt or strap 16 is changed. This is particularly useful where the cushion members 12 and 14 are asymmetrically formed on at least one major side, as described hereinafter with reference to FIG. 4.

While the user sits on the horizontal buttocks support member 42 and rests his or her back against the seat back 18 and the cushion members 12 and 14 attached thereto, the user takes slow breaths, expanding the rib cage into the cushion members, increasing awareness of the back's posture. The user becomes more cognizant of spinal alignment and back posture, and tends to sit straighter, moving the head also into a better postural position, thereby reducing the misalignment and bad posture that leads to chronic back pain.

Figure 4:
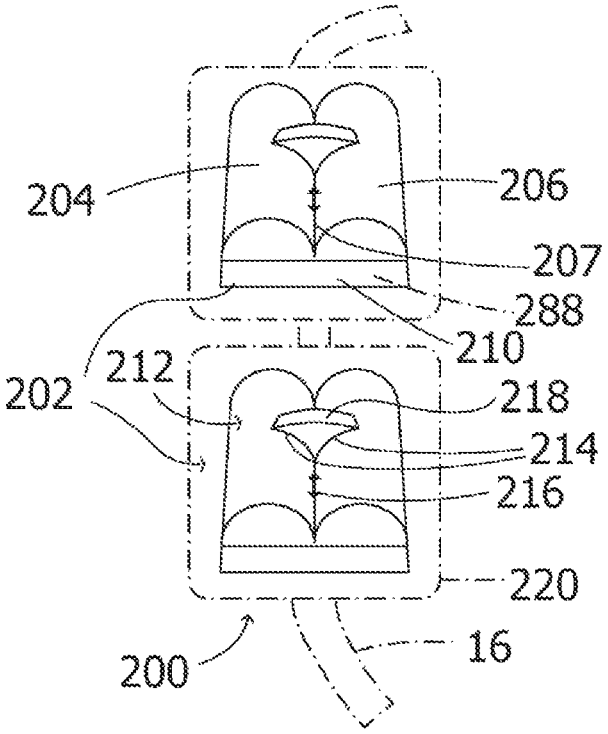
FIG. 4 is a schematic isometric view of a posture alignment device or assembly in accordance with the present invention, for use by a user in a seated posture.

FIG. 4 shows a particular embodiment 200 of device 10 including a pair of cushion members 202 in the form of 5-inch-square blocks of resiliently compressible material, 2.5 inches thick, including on one major side two semi-cylindrical profiles or parts 204 and 206 each approximately 5 inches in length. Semi-cylindrical profiles or parts 204 and 206 are contiguous with one another along a longitudinally extending center cleft or groove 207. Preferably, semi-cylindrical profiles or parts 204 and 206 are seated atop an elongate right rectangular prism 288 with a flat or planar side or surface 210 opposite the semi-cylindrical profiles or parts 204 and 206. Cleft or cleft extends between semi-cylindrical surfaces (not separately labeled) of profile or parts 204 and 206 and has a width tapering down to zero in a direction towards flat or planar major side 210.

Optionally, device 200 may be provided with two or more wedges 212 each having a pair of concave undersurfaces 214 that engage outer surfaces (not separately designated) of semi-cylindrical profiles or parts 204 and 206 upon an insertion of the wedges into cleft 207 of exercise assist or enhancement device 202. As indicated by double headed arrows 216, wedges 212 are positionable at any point along the length of cleft 207. An upper surface 218 of each wedge 212 is preferably convex, e.g., in the form of a cylindrical sector.

Devices 202 including semi-cylindrical profiles or parts 204 and 206 may be made of any closed cell or open cell polymeric foam material and are exemplarily made of a polymeric foam material such as polyethylene (PE) or EVA foam. Cushion members 202 are enclosed in respective casings 220. Wedges 212, if provided may be stored, for instance in a grove compartment or storage bin of an automobile for use in standing exercises that include partially or fully standing on one or both devices (see FIGS. 5-10) in order to improve the integrity of foot muscle groups and enhance flexibility, balance and stability within the feet. These exercises would be performed after having sat in a seat for an extended period of time. The exercises not incidentally correct posture, spinal alignment and balance throughout the body.

Figure 5:
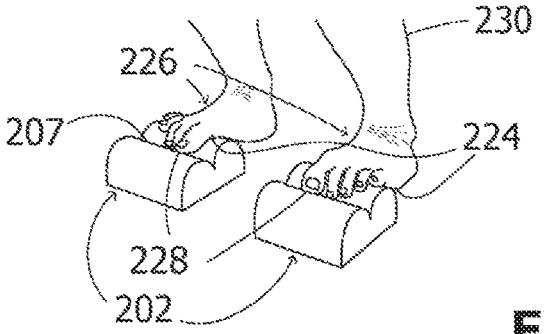

In an exercise shown in FIG. 5, the user 222 places the balls 224 of the feet 226 on respective assist devices 202 so the toes 228 relax into the center channel or cleft 207. The user 222 attends to the feeling of the upper calf 230 lengthening as the user stands with knees straight. After a few seconds, the user 222 softens the knees to release the upper calf muscles 230. This exercise is preferably repeated for a minute daily, in order to avoid lower back and heel pain (plantar fascitis).

Figure 6:
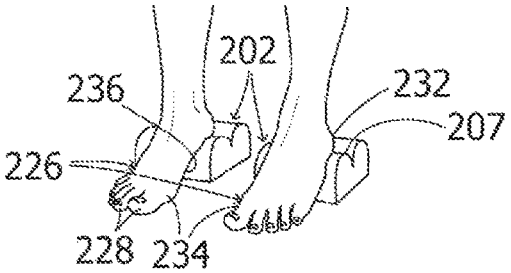

In an exercise depicted in FIG. 6, the user 222 places the backs of heels 232 at the center channel or cleft 207 and places the forefoot 234 on the floor. The user 222 tries to "dome" the arch 236 of the foot 226, imagining the heels 232 sliding towards the toes 228. This move will strengthen the toe flexors and foot intrinsics.

Figure 7:
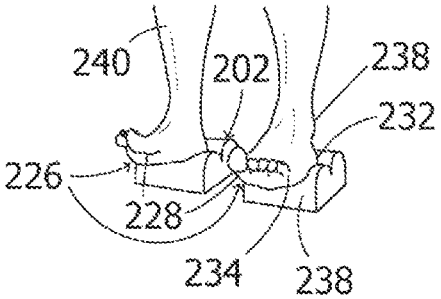

In an exercise illustrated in FIG. 7, with heels 232 on respective assist devices 202 and each forefoot 234 on the floor, the user 222 lifts the toes 228 first and then lifts the rest of the forefoot 234. This exercise awakens the tendons that cross the ankles 238. When the exercise is repeated quickly and the muscles of the ankle 238 and shin 240 will activate.

As shown in FIG. 8, in another exercise the user 222 turns assist device 202 so that center channel or cleft 207 faces the user. The user 222 inserts the wedges 212 (not visible in FIG. 11) into channels or clefts 207 slightly behind midpoints thereof. The user 222 then stands tall on wedges 212 so that the ankles 238 align with the front of the wedges 212. The user 222 will experience a realignment as the proprioceptors turn on.

As illustrated in FIG. 9, in a related exercise the user 222 places both wedges 212 in the central channel or cleft 207 of one assist device 202 to support the arch 236 of the foot 226. The user 222 repeats the exercise of FIG. 8 with one foot 236 to increase the intensity and challenge. The user's body will vibrate. In this position, the user 222 can access the "true plumb line" that runs through the body.

Per FIG. 10, the user 222 turns assist devices 202 over so flat sides or surfaces 210 (see FIG. 4) are facing upwardly. The user 222 stands on the upside-down assist devices 202 and practices balancing. During this exercise, the user 222 preferably touches a wall or chair for support. Gradually the user 222 raises his or her arms 242 to shoulder level as shown and attempts to balance. By standing on the assist devices 202 in this way the user 222 experiences micro movements throughout the body as it naturally finds a balance and center. The result is better posture and more graceful movement. When the user 222 steps off the assist devices 202, the user feels lighter and more buoyant immediately.

Figure 11:
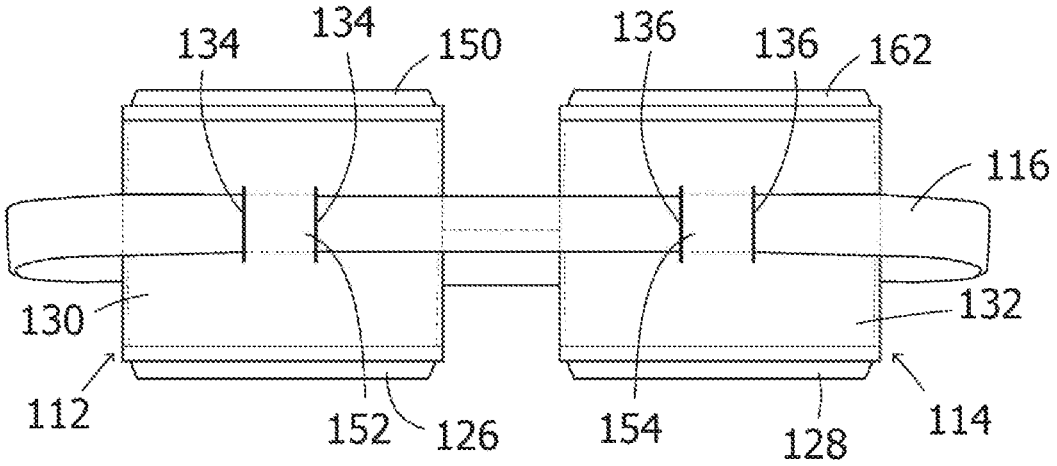
FIG. 11 is a schematic front elevational view of another embodiment of a device or apparatus for assisting a user in improving his or her sitting posture, in accordance with the present invention.

As depicted in FIG. 11, an apparatus or device 110 for improving one's sitting posture particularly exemplarily for use by office workers and others who sit at a desk or a computer during long periods comprises a pair of cushion members 112 and 114 of the geometry discussed hereinabove with reference to FIG. 4 and at least one attachment device 116 in the form of a belt or strap of elastic material connected to the cushion members for attaching the cushion members to a seat back 118 (FIGS. 12 and 13) in spaced relationship to one another.

Figure 12:
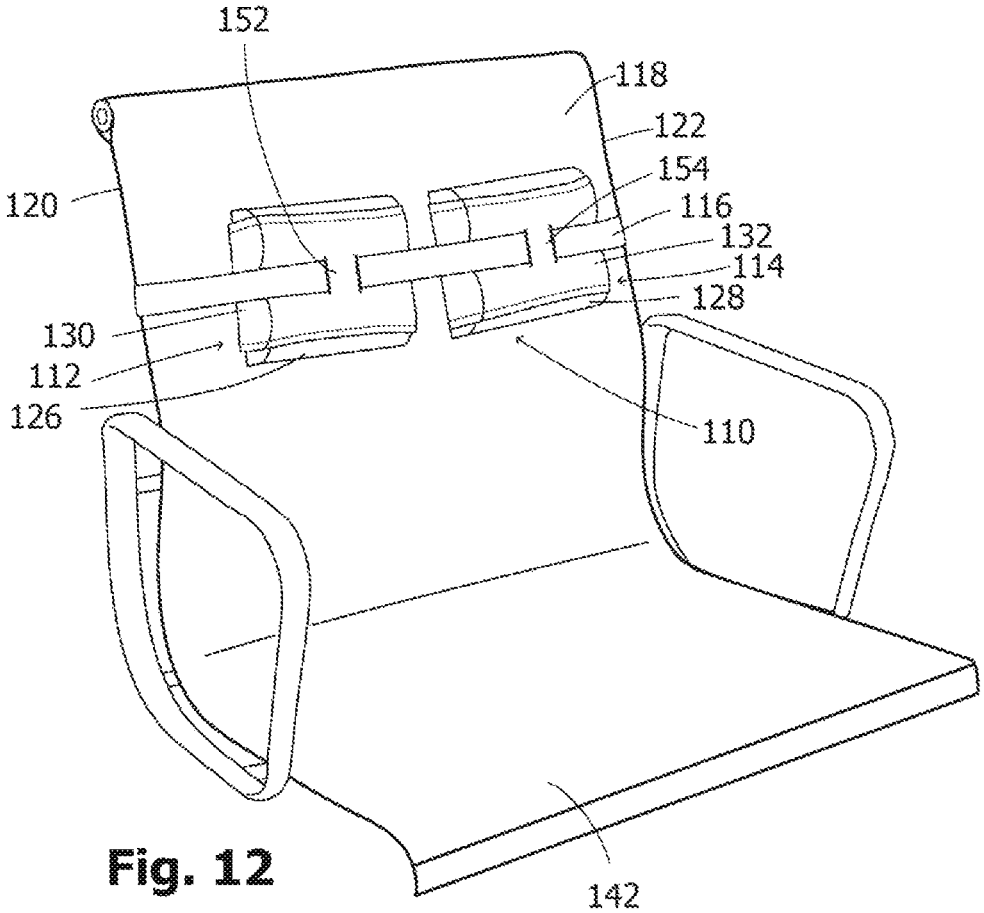
FIG. 12 is a schematic perspective view of a chair, showing the apparatus or device of FIG. 11 in a thoracic position on the seat back of the chair.

Preferably, cushion members 112 and 114 each include a body 126 and 128 made of resiliently compressible material such as closed cell polymeric foam and further includes a respective cover of easing 130 and 132 which envelops and contains the cushion body 126 and 128. As depicted in FIGS. 11 and 12 each casing 130, 132 takes the form of a sleeve that is, a cylindrical loop or endless belt of fabric material with openings 130' and 132' (only one visible for each casing) on opposite sides through which the cushion bodies 126 and 128 may be removably inserted into the covers or casings.

Covers or casings 130 and 132 are each provided on a front major side (facing the user USR and away from a seatback 118) with two slits 134, 134' and 136, 136' extending parallel to one another and defining a respective loop 152, 154 of the fabric material of the respective cover or casing 130, 132. Belt or strap 116 is inserted through slits 134, 134' and 136, 136 so as to pass under the respective loops 152, 154 to thereby slidably securing the cushion members 112 and 114 to the belt or strap 116 and to seatback 118.

One cushion member 112 is positioned proximate one vertical side or edge 120 of seat back 118, while the other cushion member 114 is placed near an opposite vertical side or edge 122 of the seat back. Thus cushion member 112 is much closer to side 120 than to side 122, while cushion member 114 is much closer to side 122 than to side 120.

During use of the apparatus or device 110, cushion members 112 and 114 are spaced from one another along the belt or strap 116. Belt or strap 16 is preferably an endless, at least partially elastic band that enable a user to stretch the belt or strap over cushion members 112 and 114 and around seat back 118. Alternatively, belt or strap 116 may be made of an inelastic material with fasteners provided for securing the belt or strap to seatback 118, as discussed above. Cushion members 112 and 114 may be slid along belt or strap 116 before or after the attachment of the device to seat back 118, to adjust the spacing of the cushion members and thus adapt the device to the user's personal requirements. Cushion members 112 and 114 are preferably positioned in order to contact the user's back along the sides thereof, along the thoracic region of the user's spine. However, the apparatus or device 110 may be positioned at a different vertical location according to the user's needs, for instance, in the lumbar region.

A method for maintaining spinal alignment in a seated position comprises providing cushion members 112 and 114 and attaching them to seat back 118 along or proximate respective vertical edges 120 and 122 thereof, so that the cushion members are spaced from one another and are located at substantially the same height or vertical distance from a horizontal support 142 attached to the seat back 118. Thus the device 110, including the cushion members 112, 114, is positioned in posterior lateral area or side body, exemplarily about 6 inches down from the armpits.

Figure 13:
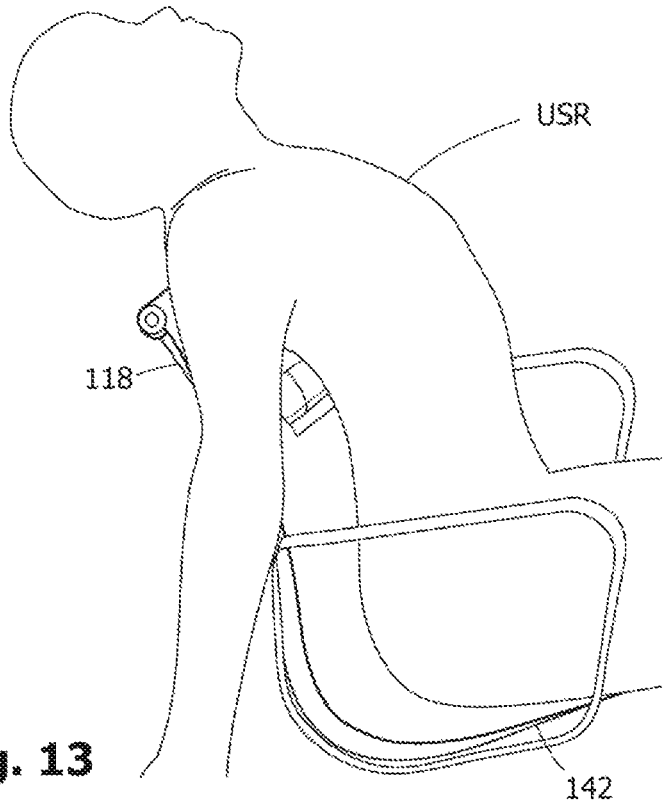
FIG. 13 is a schematic perspective view showing a use of the device of FIGS. 11 and 12.

The attaching of the cushion members 112 and 114 to the seat back preferably includes stretching belt or strap 116 about seat back 118, the cushion members being attached to the belt or strap beforehand. Where cushion members 112 and 114 include respective sleeve-configured slip-covers or casings 130 and 132, the attaching of the cushion members 112 and 114 to the seat back 118 typically includes inserting cushion body members 126 and 128 each in the form of cushion member 202 (FIG. 4) into the sleeve-configured casings 130, 132 so that grooves or center clefts 207 are oriented orthogonally to slits 134, 134' and 136, 136'. The attaching of the cushion members 112 and 114 to the seat back 118 further includes inserting belt or strap 116 through slits 134, 134' and 136, 136' so that the belt passes underneath loops 152 and 154. When the apparatus or device is properly attached to seatback 118, recesses or center clefts 207 are oriented horizontally and belt or strap 116 is disposed partially within the recesses or center clefts and, on the opposite sides or flanks of loops 152, 154, presses the material of the covers or casings 130, 132 into the grooves or center clefts. Thus, semi-cylindrical profiles or parts 204 and 206 face away from seatback 118 and engage the back of the user USR (FIG. 13). Flat or planar sides or surfaces 210 (FIG. 4) of body members 126, 128 are disposed against seatback 118, with the material of slip-covers or casings 130, 132 sandwiched between.

Wedges 212 are not used in the apparatus or device 110, but are rather useful in knee and foot exercises described above with reference to FIGS. 5-10.

While the user USR sits on the horizontal support 142 and rests his or her back against the seat back 118 and the cushion members 112 and 114 attached thereto (FIG. 13), the user USR takes slow breaths, expanding the rib cage into the cushion members, increasing awareness of the back's posture. The user USR becomes more cognizant of spinal alignment and back posture, and tends to sit straighter, moving the head also into a better postural position, thereby reducing the misalignment and bad posture that leads to chronic back pain.

When the user USR leans back against the apparatus or device 110 attached to seatback 118 (FIG. 12) and rolls the arched back over the apparatus or device 110, as shown in FIG. 13, the fascia of the thoracic region are stretched over the semi-cylindrical profiles or parts 204 and 206, releasing tension in the fascia. In addition, one or more wedges 212 (FIG. 4) may be inserted into the cleft or groove 207 (FIG. 4) of cushion member 112 and/or 114 at any position along the cleft or groove for providing pressure point massage to one or more desired locations on the back of the user USR. The wedges 212 may be installed by pulling an edge 160, 162 of sleeve 130, 132 in a direction perpendicular to the center cleft or groove 207, stretching or deforming the sleeve on one side to allow access to the cleft or groove 207.

Although the invention has been described in terms of particular embodiments and applications, one of ordinary skill in the art, in light of this teaching, can generate additional embodiments and modifications without departing from the spirit of or exceeding the scope of the claimed invention. For instance, belts or straps 16 and 116 may be replaced by any suitable form of a user attachment component that enables attachment of the device 10, 110 to a seat back 18, 118 so that the elongate resiliently compressible cushion members 12, 112 and 14, 114 are maintained in substantial or approximate relation to one another on opposite sides of the seat back and concomitantly along opposite sides of a user's back when the user sits against seat back 18, 118. For instance, VELCRO type hook-and-loop attachment elements may be fixed to the seat and to cushion members 12 and 14.

Casings 30 and 32 may be permanently or removably coupled to the elastic belt member 16. Casings 30 and 32 may be provided with flaps or large slits (not shown) that may enable the removal of cushion bodies 26 and 28 from the casings, so that the cushion bodies, particularly if they take the form of cushion members 202 (FIG. 4), can be used in foot exercises for rebalancing or re-centering the body after an extended time in the asymmetric position of an automobile driver, where the right foot is extended to operate the brake and accelerator pedals and the arms are raised to manipulate the steering wheel.

Accordingly, it is to be understood that the drawings and descriptions herein are proffered by way of example to facilitate comprehension of the invention and should not be construed to limit the scope thereof.

What is claimed is:

1. An apparatus for improving sitting posture, comprising:

a pair of cushion members, each of said cushion members being flat or planar on one major side and formed with a pair of substantially semi-cylindrical surfaces on an opposite major side, said substantially semi-cylindrical surfaces being separated from one another by an elongate groove or cleft, said cushion members each being contained in a casing, each said casing being provided with a plurality of slits;

at least one attachment device connected to said cushion members for attaching said cushion members to a seat back at mutually spaced locations thereon, said attachment device including a belt or strap extending parallel to and at least partially within said elongate groove or cleft in the respective ones of said cushion members, said cushion members being spaced from one another along said belt or strap, said belt or strap being inserted through and traversing said slits; and a fastener on said belt or strap to lock same to the seat back.

2. The apparatus defined in claim 1 wherein each said casing has two slits oriented in parallel to one another on a front side of the respective casing to define a loop in the respective casing.

3. The apparatus defined in claim 2 wherein said belt or strap passes underneath said loop, between said loop and a respective one of said cushion members, said belt or strap extending over the respective casing on opposite sides of said loop.

4. An apparatus for improving sitting posture, comprising:

a pair of cushion members, each of said cushion members being flat or planar on one major side and formed with a pair of substantially semi-cylindrical surfaces on an opposite major side, said substantially semi-cylindrical surfaces being contiguous with one another, an elongate groove or cleft extending between said substantially semi-cylindrical surfaces, said elongate groove or cleft having a width tapering down to zero in a direction towards said one major side; and an attachment device including a belt or strap, said groove or cleft of each of said cushion members being oriented parallel to said belt or strap, said belt or strap extending over and in said groove or cleft of each of said cushion members.

5. The apparatus defined in claim 4 wherein said cushion members each include a body enveloped in a casing, said casing being provided with a plurality of slits, said belt or strap being inserted through and traversing said slits.

6. The apparatus defined in claim 5 wherein said casing is a sleeve, a respective one of said cushion members being slidably inserted into said sleeve.

7. The apparatus defined in claim 5 wherein said slits are two in number and oriented in parallel to one another on a front side of said casing to define a loop in said casing, said casing on opposite sides of said loop being disposed between said groove or cleft on an inner side and said belt or strap on an outer side.

8. A method for maintaining spinal alignment in a seated position, comprising:

providing a pair of cushion members, each of said cushion members being flat or planar on one major side and formed with a pair of substantially semi-cylindrical surfaces on an opposite major side, said substantially semi-cylindrical surfaces being separated from one another by an elongate groove or cleft; and attaching said cushion members to a seat back, so that:

said cushion members are spaced from one another and are located at a common height or vertical distance from a horizontal buttocks support member attached to said seat back; and said elongate groove or cleft of each of said cushion members extends horizontally and parallel to said horizontal buttocks support member.

9. The method defined in claim 8 wherein the attaching of said cushion members to said seat back includes fastening a belt or strap about said seat back, said cushion members being attached to said belt or strap.

10. The method defined in claim 9 wherein said cushion members are disposed in covers or casings provided with at least one set of mutually parallel slits, the attaching of said cushion members to said seat back includes inserting said belt or strap through said slits.

11. The method defined in claim 10 wherein said covers or casings are sleeves, further comprising inserting said cushion members into said sleeves.

12. The method defined in claim 8, further comprising sitting on said horizontal buttocks support member while resting against said cushion members attached to said seat back.

13. The method defined in claim 8 wherein the attaching of said cushion members to said seat back includes disposing a belt or strap about said seat back and over said cushion members so that said cushion members are held between said seat back and said belt or strap.

14. The method defined in claim 13 wherein the attaching of said cushion members to said seat back further includes attaching said cushion members to said belt or strap.

15. The method defined in claim 14, further comprising inserting said cushion members into respective sleeves, the attaching of said cushion members to said belt or strap including attaching said belt or strap to said sleeves.

16. The method defined in claim 15 wherein the attaching of said cushion members to said seat back further includes orienting said cushion members so that said one major side is juxtaposed to said seat back while said opposite major side faces in a direction away from said seat back, further comprising orienting said cushion members so that the respective grooves or recesses extend parallel to said belt or strap, with said belt or strap extending over and in said grooves or recesses.

* * * * *